US006535236B1

(12) United States Patent
Chappel et al.

(10) Patent No.: US 6,535,236 B1
(45) Date of Patent: Mar. 18, 2003

(54) REFERENCING MECHANISM FOR AN IMAGING APPARATUS

(75) Inventors: Billy Carl Chappel, Mt. Sterling, KY (US); Christopher Gregory Chee, Lexington, KY (US); Gordon Robert Dunning, Versailles, KY (US); Paul Douglas Horrall, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/710,503

(22) Filed: Nov. 9, 2000

(51) Int. Cl.[7] ..... B41J 2/435
(52) U.S. Cl. ..... 347/263; 347/245; 347/257
(58) Field of Search ..... 347/242, 245, 347/238, 257, 263, 256; 355/1, 46

(56) References Cited

U.S. PATENT DOCUMENTS

| | | | | |
|---|---|---|---|---|
| 3,450,868 A | | 6/1969 | Ebling et al. | 318/572 |
| 3,573,849 A | | 4/1971 | Herriot et al. | 347/248 |
| 3,970,781 A | | 7/1976 | Dalton et al. | 358/480 |
| 4,728,981 A | * | 3/1988 | Koek et al. | 355/1 |
| 5,140,340 A | | 8/1992 | Stephenson | 347/177 |
| 5,452,073 A | | 9/1995 | Kataoka | 399/299 |
| 5,737,003 A | | 4/1998 | Moe et al. | 347/116 |
| 5,751,305 A | | 5/1998 | Hadley | 347/19 |
| 5,764,269 A | | 6/1998 | Takeshita et al. | 347/233 |
| 5,844,222 A | | 12/1998 | Ackley et al. | 235/454 |
| 6,043,835 A | | 3/2000 | AuYeung et al. | 347/247 |
| 6,194,713 B1 | * | 2/2001 | Kanazawa | 250/234 |

* cited by examiner

*Primary Examiner*—Hai Pham
(74) *Attorney, Agent, or Firm*—Ronald K. Aust

(57) ABSTRACT

An imaging apparatus includes a machine frame, a printhead housing containing a printhead for generating a laser beam, and a position sensing device. The position sensing device includes a position sensing device frame and a position sensor for sensing a position of the laser beam. The position sensing device frame is interposed between the machine frame and the printhead housing. Each of the machine frame, the printhead housing and the position sensing device frame include at least one reference feature that in combination accurately reference the position of the printhead housing to the machine frame.

29 Claims, 5 Drawing Sheets

REFERENCING MECHANISM FOR AN IMAGING APPARATUS

BACKGROUND OF THE INVENTION

1. Field of the Invention

The present invention relates to an imaging apparatus, and, more particularly, to an arrangement of components having reference features which combine to accurately reference the position of a printhead housing to a machine frame of the imaging apparatus.

2. Description of the Related Art

In a typical in-line color electrophotographic imaging process, latent images are formed on a plurality of photosensitive drums, which are in turn each developed using a predetermined color of toner. Typically, these colors are black, magenta, cyan and yellow. The developed images are then transferred to either an intermediate transfer medium or directly to a sheet of media (such as paper) that travels past the photosensitive drums. The image in each color is created one line at a time, and the lines are oriented at right angles to the direction of travel of the media. The individually-generated images combine to form a full-color image. Thus, in a typical multi-color laser printer, the sheet of media receives color images generated at each of the four image developing stations.

It is recognized that in order for the multi-color laser printer to print accurately, the laser beams for all four colors must be in alignment, both in the scan direction (i.e., the direction the laser sweeps across the photoreceptive medium) and the process direction (feed direction of the print medium). However, providing proper alignment of even a single laser printhead in relation to the sheet of media in the process direction can be difficult. This problem is compounded with the addition of each printhead, since the plurality of printheads must be in registration so that the individual images generated by each printhead can be superimposed correctly when combined.

What is needed in the art is a referencing mechanism that accurately references the position of a printhead housing containing a printhead to a machine frame of the imaging apparatus.

SUMMARY OF THE INVENTION

The present invention provides a referencing mechanism that accurately references the position of a printhead housing containing a printhead to a machine frame of the imaging apparatus.

The invention comprises, in one form thereof, an imaging apparatus that includes a machine frame, a printhead housing and a position sensing device. The printhead housing includes a laser printhead which generates a laser beam. The position sensing device includes a position sensing device frame and a position sensor for sensing a position of the laser beam. The position sensing device frame is interposed between the machine frame and the printhead housing. Each of the machine frame, the printhead housing and the position sensing device frame includes at least one reference feature that in combination accurately reference the position of the printhead housing to the machine frame.

An advantage of the present invention is that the position sensing device forms an absolute datum for the printhead housed in the printhead housing, and the position sensing device is directly referenced to the machine frame.

Another advantage of the invention, when applied to a laser printer, is that since the position sensing device forms an absolute datum for the laser printhead housed in the printhead housing, and since the position sensing device is directly referenced to the machine frame, then the position of the sensed laser beam is directly related to a position on the photoconductive drum attached to the machine frame.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

DETAILED DESCRIPTION OF THE INVENTION

Figure 1:
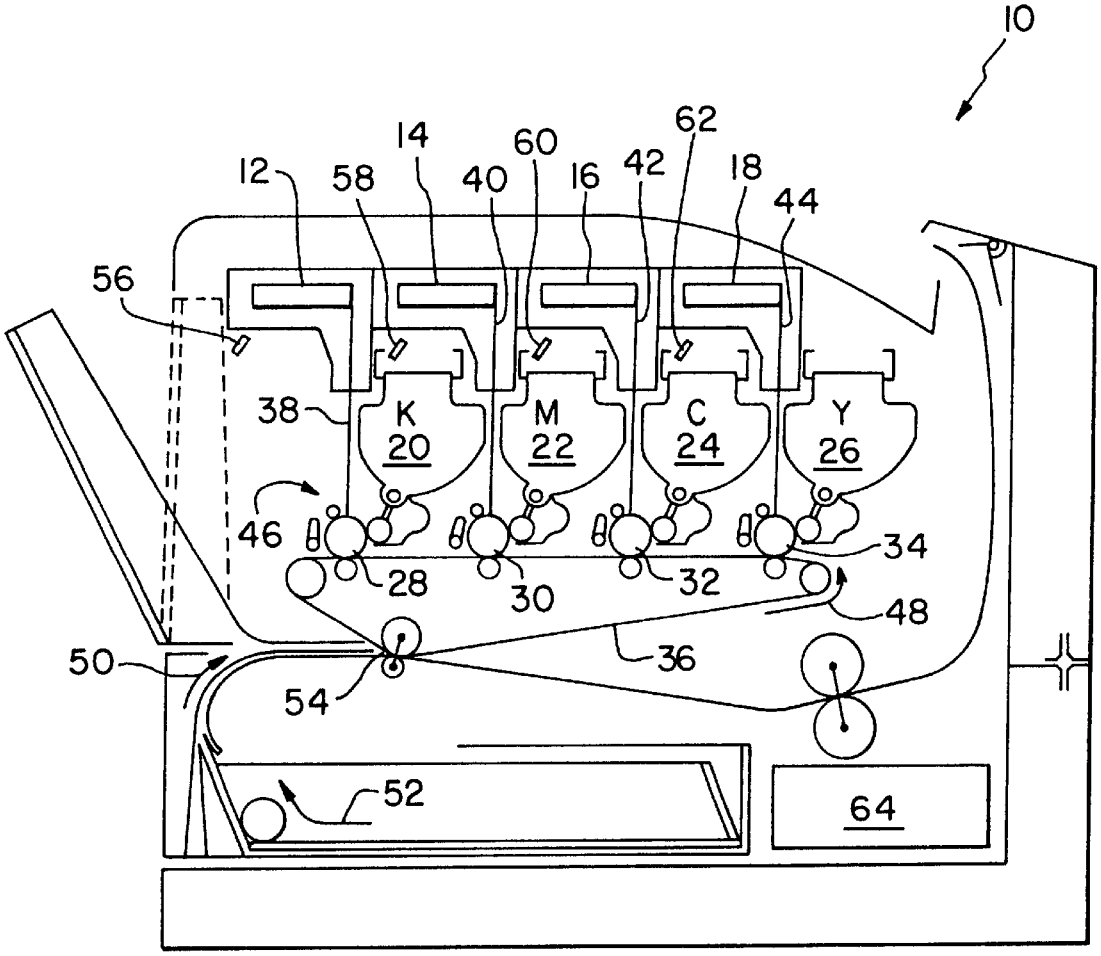
FIG. 1 is a side view in schematic of a multicolor laser printer embodying the present invention.

Referring now to the drawings and, more particularly, to FIG. 1, there is shown one embodiment of a multicolor laser printer 10 including laser printheads 12, 14, 16, 18, a black toner cartridge 20, a magenta toner cartridge 22, a cyan toner cartridge 24, a yellow toner cartridge 26, photoconductive drums 28, 30, 32, 34, and an intermediate transfer member belt 36.

Each of laser printheads 12, 14, 16 and 18 include optical components, such as lenses and a rotatable multi-faceted mirror, which focus and scan a respective laser beam 38, 40, 42, 44 in a scan direction, perpendicular to the plane of FIG. 1, across a respective one of photoconductive drums 28, 30, 32 and 34. Each of photoconductive drums 28, 30, 32 and 34 is negatively charged to approximately −900 volts and is subsequently discharged to a level of approximately −200 volts in the areas of its peripheral surface that are impinged by a respective one of laser beams 38, 40, 42 and 44 to form a latent image thereon made up of a plurality of dots, or spots. During each scan of a laser beam across a photoconductive drum, each of photoconductive drums 28, 30, 32 and 34 is continuously rotated, clockwise in the embodiment shown, in a process direction indicated by direction arrow 46. The scanning of laser beams 38, 40, 42 and 44 across the peripheral surfaces of the photoconductive drums is cyclically repeated, thereby discharging the areas of the peripheral surfaces on which the laser beams impinge.

The toner in each of toner cartridges 20, 22, 24 and 26 is negatively charged and is conveyed by an electrically conductive roller. During the printing operation, the conveyance roller is biased to approximately −600 volts. Thus, when the toner from cartridges 20, 22, 24 and 26 is brought into contact with a respective one of photoconductive drums 28, 30, 32 and 34, the toner is attracted to and adheres to the portions of the peripheral surfaces of the drums that have been discharged to −200 volts by the laser beams. As belt 36 rotates in the direction indicated by arrow 48, the toner from each of drums 28, 30, 32 and 34 is transferred to the outside surface of belt 36. As a print medium, such as paper, travels along either path 50 or duplexing path 52, the toner is transferred to the surface of the print medium in nip 54.

Each of printheads 12, 14, 16 and 18 includes a respective one of sensor devices 56, 58, 60 and 62, each of which is placed near the end of a scan line of the associated laser beam, and is used to determine an orientation of the laser printhead in the process direction and the scan line direction. Also, each of printheads 12, 14, 16 and 18 is electrically coupled to and controlled by a printhead controller 64. Sensor devices 56, 58, 60 and 62 sense the position of the respective laser beams 38, 40, 42, 44 on a real time basis.

Printhead controller 64 includes microprocessor and data signal processing modules, such as a raster image processor (RIP), for processing print data received from a source computer (not shown). In addition, printhead controller 64 includes modules for processing sensor information received from each of sensor devices 56, 58, 60 and 62 for detecting the occurrence of laser scan process direction and scan line direction position errors.

Figure 2:
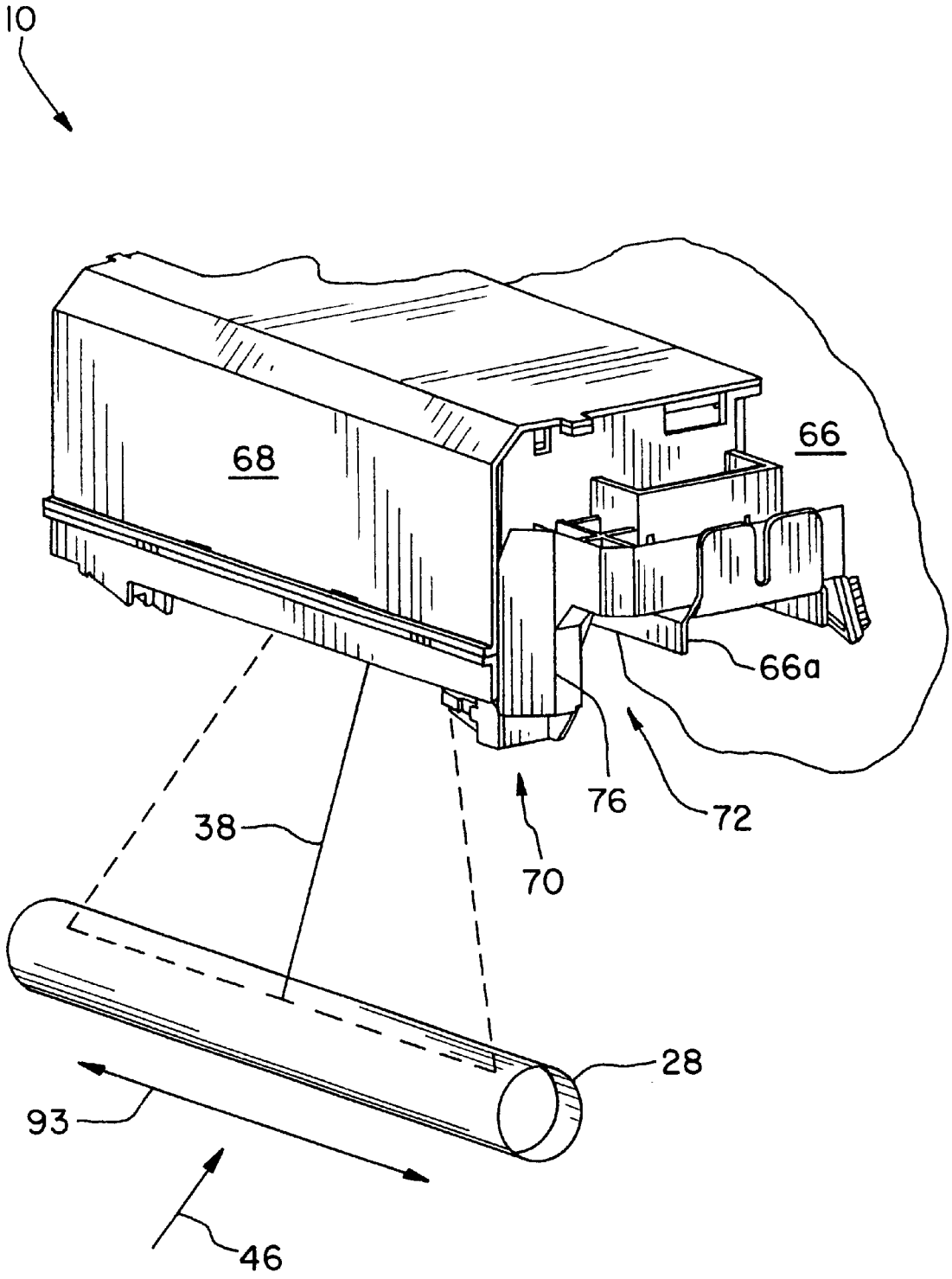
FIG. 2 is a partial perspective view of the multicolor laser printer embodying the present invention.

FIG. 2 shows a portion of laser printer 10 including a machine frame 66, a printhead housing 68 and a position sensing device 70 which are positioned in relation to a photoconductive drum, such as for example, photoconductive drum 28. Printhead housing 68 is used to house a laser printhead, such as laser printhead 12. It is to be understood that each of laser printheads 12, 14, 16, 18 is housed in a printhead housing like that of printhead housing 68. Printhead housing 68 must be accurately referenced to the associated photoconductive drum, e.g., photoconductive drum 28 as shown. In the present invention, as will be described in more detail below, each of machine frame 66, printhead housing 68 and position sensing device 70 include at least one reference feature that in combination accurately reference the position of printhead housing 68, and in turn the associated printhead, with respect to machine frame 66, and in turn the associated photoconductive drum.

Figure 3:
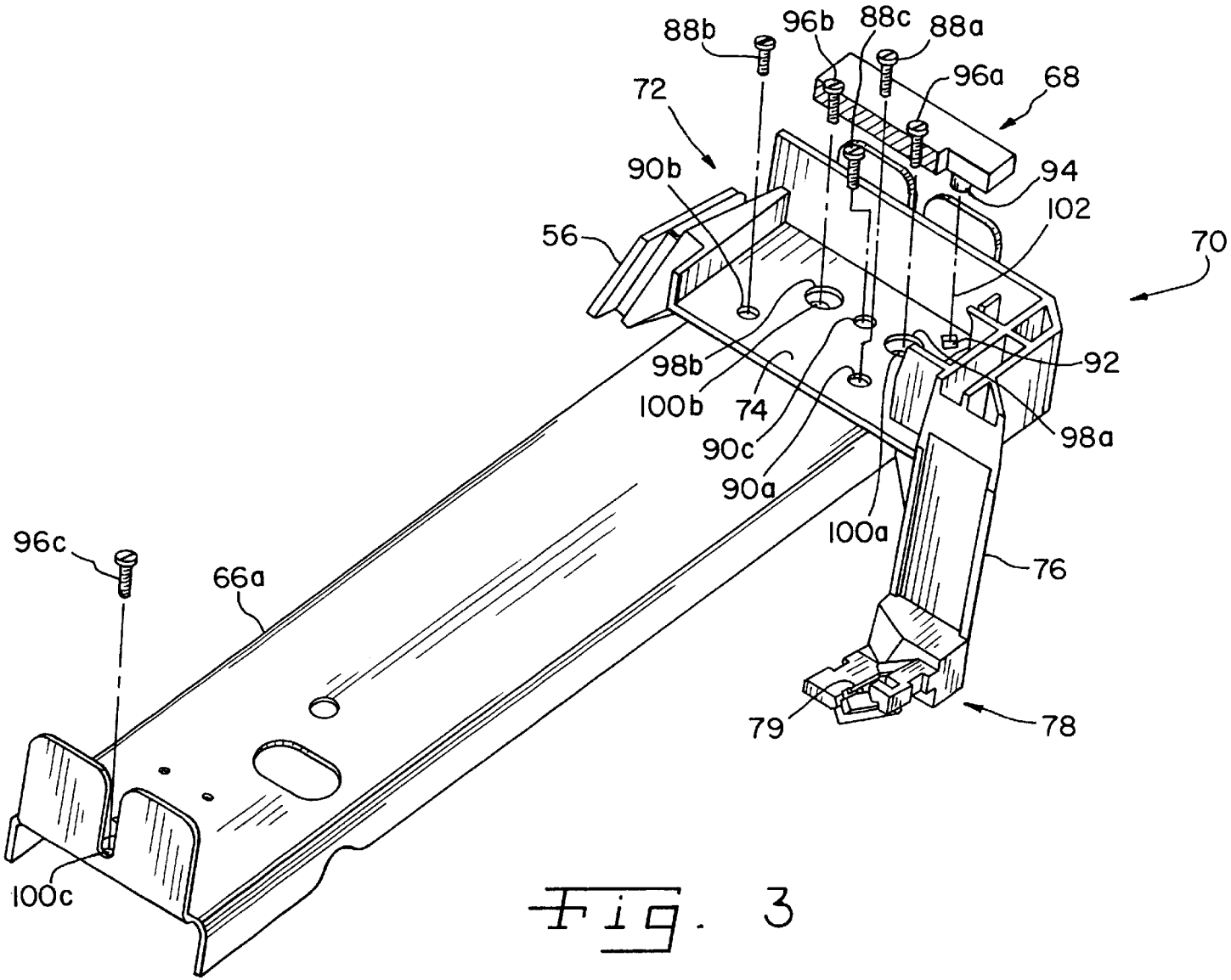
FIG. 3 is a perspective view of an arrangement of components for mounting a printhead housing to a machine frame, with the printhead housing shown in section.

Referring to FIGS. 2 and 3, position sensing device 70 includes a position sensing device frame 72 and a position sensor, such as sensor device 56, for sensing a position of laser printhead housing 68 by sensing an orientation of the laser beam, e.g., laser beam 38 as shown in FIG. 2. Position sensing device frame 72 is interposed between machine frame 66 and laser printhead housing 68 for mounting laser printhead housing 68 to machine frame 66.

Referring to FIG. 3, preferably, position sensing device frame 72 is formed as a unitary structure. Position sensing device frame 72 includes a mounting bracket 74 and an arm 76 extending downwardly from bracket 74. Arm 76 has a distal end 78 to which a mirror 79 is mounted that reflects the laser beam 38 (see FIG. 2) to the laser beam sensor 56. A length and orientation of arm 76 is selected to provide the desired location and orientation of the mirror 79 that reflects laser beam 38 to sensor device 56 with respect to mounting bracket 74.

Figure 4A:
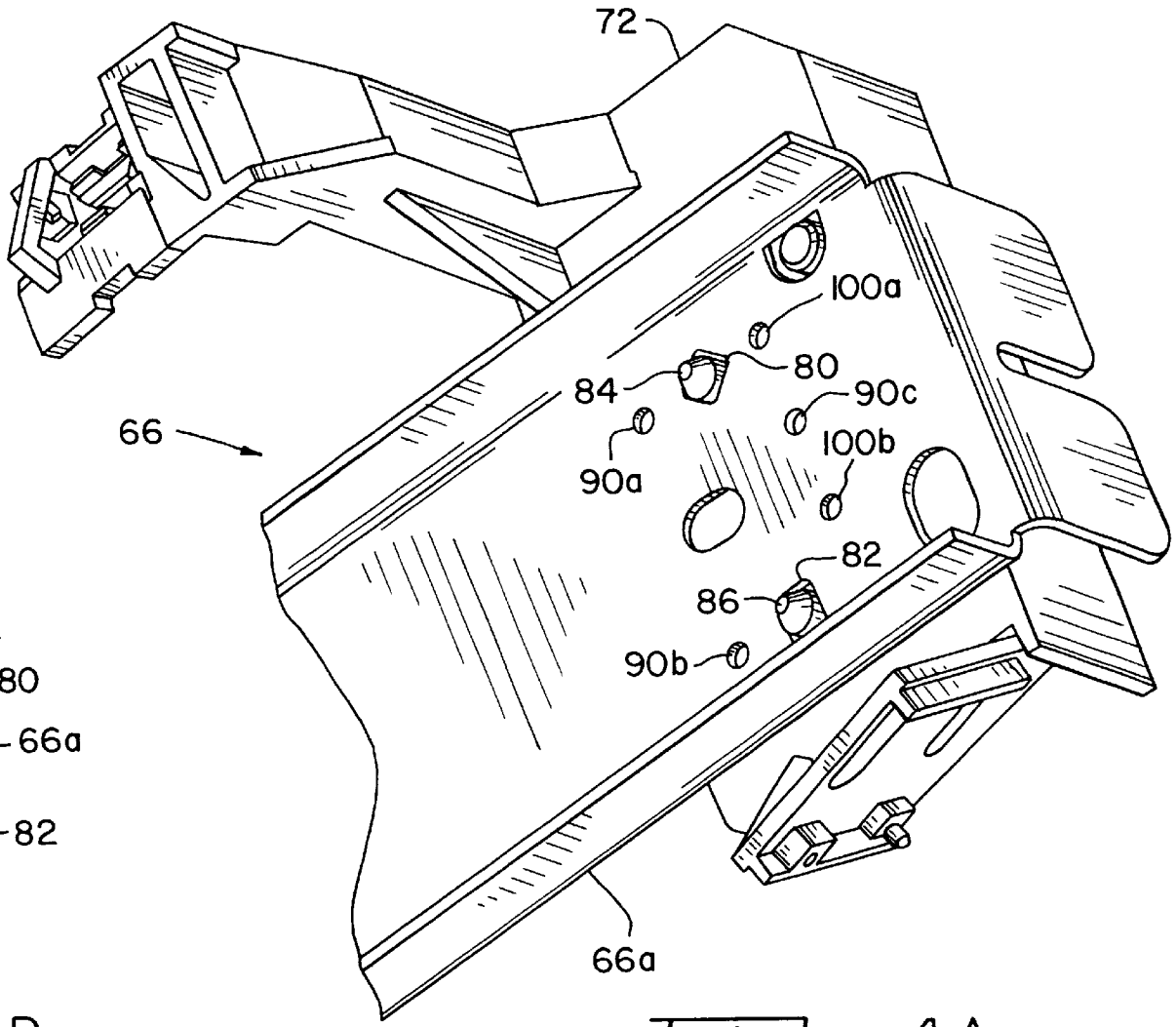
FIG. 4A is a bottom perspective view of the arrangement depicted in FIG. 3.
Figure 4B:
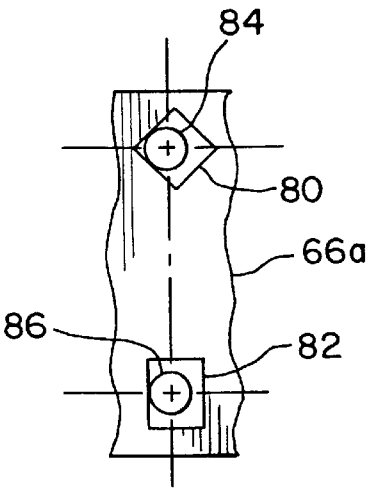
FIG. 4B is a partial bottom plan view of the arrangement shown in FIG. 4A.

Referring to FIGS. 4A and 4B, machine frame 66 includes a first reference hole 80 and a second reference hole 82 that are spaced apart along the width of a frame channel 66*a* forming a part of machine frame 66. Correspondingly, position sensing device frame 72 includes a first alignment pin 84 and a second alignment pin 86 that are spaced apart and extend from a surface of mounting bracket 74. First alignment pin 84 engages first reference hole 80 which is polygonal in shape, such as diamond shaped, and forms a V-slot. Second alignment pin 86 engages second reference hole 82 which is rectangular in shape. Preferably, first alignment pin 84 is biased against two sides of the V-slot, and second alignment pin 86 is biased against one side of the rectangular slot. The two sides of the V-slot to which pin 84 is biased forms stops which limit the travel of pin 84 in a direction substantially parallel to an extent of the side against which pin 86 is biased.

Once the first and second alignment pins 84, 86 are received into first and second reference holes 80, 82, respectively, position sensing device frame 72 is fixedly secured to machine frame 66 by a plurality of fasteners 88*a*, 88*b*, 88*c* such as bolts or screws, which pass through fastener holes 90*a*, 90*b*, 90*c* in position sensing device frame 72 and are threaded into corresponding fastener apertures in machine frame 66. Accordingly, position sensing device 70 is directly referenced to machine frame 66.

Figure 5:
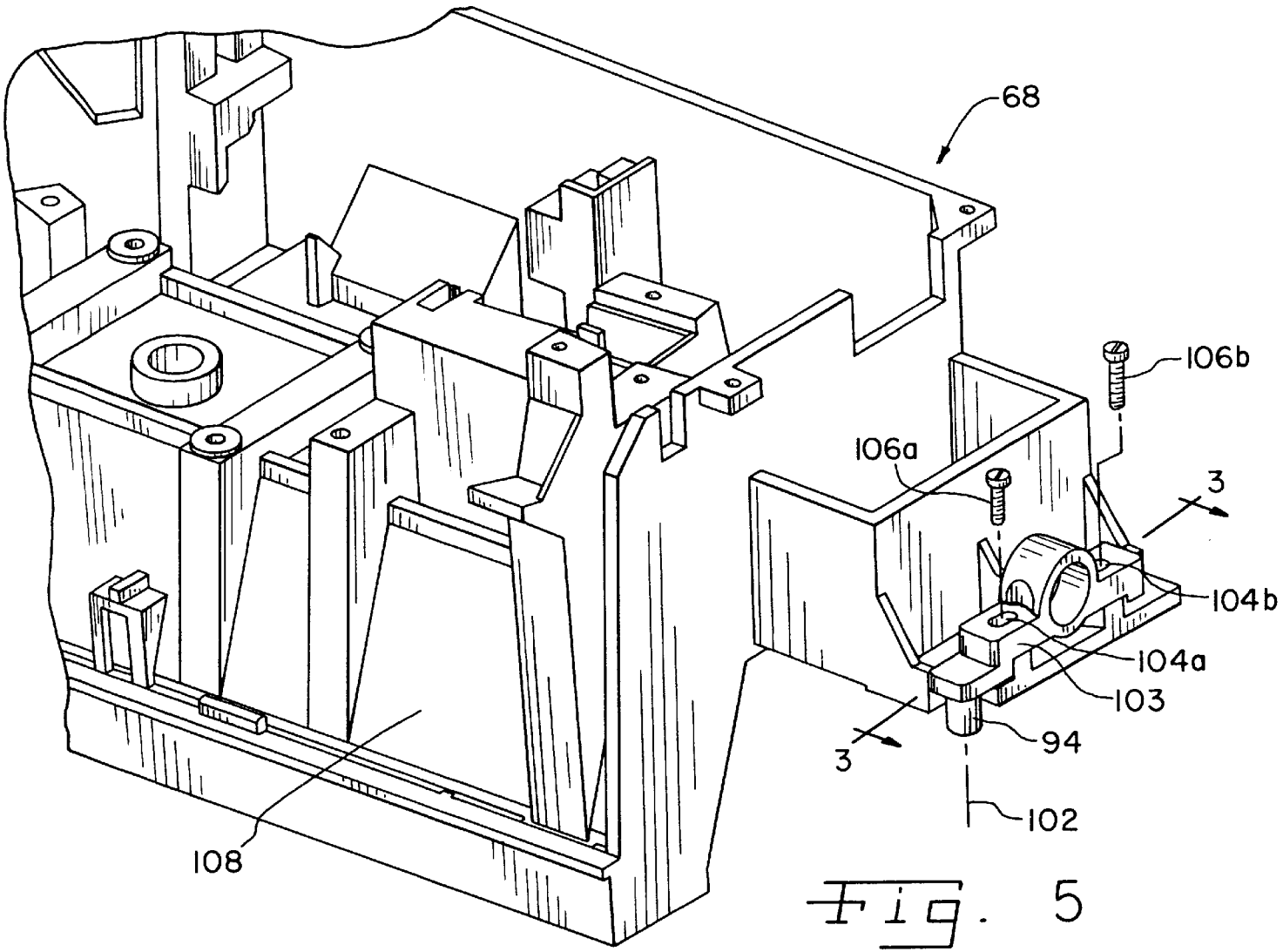
FIG. 5 is a partial perspective view of the printhead housing used in conjunction with the present invention.

In FIG. 3, printhead housing 68 is sectioned away to more clearly shown the reference features and mounting accommodations provided by frame channel 66*a*, printhead housing 68 and position sensing device frame 72. Referring now to FIGS. 3 and 5, position sensing device frame 72 further includes a reference datum 92 and printhead housing 68 includes a datum locator 94, such as a pin, for engaging reference datum 92. Thus, position sensing device 70 provides an absolute datum for referencing the position of printhead housing 68, and in turn, provides an absolute datum for the printhead housed in printhead housing 68. Preferably, reference datum 92 has a polygonal shape, and more preferably, forms a V-shaped slot. Reference datum 92 (see FIG. 3) is located to align the printhead of printhead housing 68 in both the process direction depicted by direction arrow 46 and the scan direction depicted by direction arrows 93 (see FIG. 2).

Referring to FIGS. 2, 3 and 5, once datum locator 94 is received into reference datum 92 and the initial positioning of laser printhead housing 68 is complete, laser printhead housing 68 is secured to machine frame 66 by a plurality of fasteners 96*a*, 96*b* and 96*c* (FIG. 3) which extend through pass through holes 98*a*, 98*b*, respectively, in position sensing device frame 72 and are threaded into corresponding fastener apertures 100*a*, 100*b*, 100*c* in frame channel 66*a* of machine frame 66. With fasteners 96*a*, 96*b* and 96*c* loosened, laser printhead housing 68 can be pivoted about axis 102 (FIG. 5) to effect skew correction. Fasteners 96*a*, 96*b*, 96*c* are then tightened when printhead housing 68 is in the desired position.

As shown in FIG. 5, laser printhead housing 68 includes a mounting fixture 103 which includes datum locator 94. Fixture 103 further includes slotted apertures 104*a*, 104*b* which, along with fasteners 106*a*, 106*b* facilitate the adjustment of the location of datum locator 94 with respect to the body 108 of laser printhead housing 68. In particular, slotted apertures 104*a*, 104*b* allow datum locator 94 to be moved in the process direction 46.

Accordingly, in practicing the present invention, position sensing device 70 is positioned with respect to the referencing features formed on machine frame 66 of printer 10, and printhead housing 68 is positioned with respect to referencing features formed on position sensing device 70. Thus, position sensing device 70 forms an absolute datum for the laser printhead housed in printhead housing 68, and position sensing device 70 is directly referenced to machine frame 66, which in turn directly relates the position of the sensed laser beam to a position on the associated photoconductive drum.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a machine frame;

a printhead housing containing a laser printhead which generates a laser beam; and a position sensing device, said position sensing device including a position sensing device frame and a position sensor for sensing a position of the laser beam, said position sensing device frame being interposed between said machine frame and said printhead housing, wherein each of said machine frame, said printhead housing and said position sensing device frame includes at least one reference feature that in combination accurately reference the position of said printhead housing to said machine frame.

2. The imaging apparatus of claim 1, wherein one of said machine frame and said position sensing device frame includes a first reference hole and the other of said machine frame and said position sensing device frame includes a first alignment pin for engaging said first reference hole.

3. The imaging apparatus of claim 2, wherein said first reference hole forms a V-shaped slot.

4. The imaging apparatus of claim 2, wherein said first reference hole forms a slot having a polygonal shape.

5. The imaging apparatus of claim 2, wherein said position sensing device frame is secured to said machine frame by a plurality of fasteners.

6. The imaging apparatus of claim 2, wherein one of said printhead housing and said position sensing device frame includes a first reference datum and the other of said printhead housing and said position sensing device frame includes a first datum locator for engaging said first reference datum.

7. The imaging apparatus of claim 6, wherein said first reference datum forms a V-shaped slot.

8. The imaging apparatus of claim 6, wherein said first reference datum forms a slot having a polygonal shape.

9. The imaging apparatus of claim 6, wherein said printhead housing is secured to said machine frame by a plurality of fasteners.

10. The imaging apparatus of claim 6, wherein said printhead housing includes a slotted aperture for adjusting a location of said first datum locator relative to a body of said printhead housing.

11. The imaging apparatus of claim 1, wherein one of said machine frame and said position sensing device frame includes a first reference hole and the other of said machine frame and said position sensing device frame includes a first alignment pin for engaging said first reference hole, and wherein one of said machine frame and said position sensing device frame includes a second reference hole and the other of said machine frame and said position sensing device frame includes a second alignment pin for engaging said second reference hole.

12. The imaging apparatus of claim 11, wherein at least one of said first reference hole and said second reference hole forms a V-shaped slot.

13. The imaging apparatus of claim 11, wherein at least one of said first reference hole and said second reference hole forms a slot having a polygonal shape.

14. The imaging apparatus of claim 11, wherein said position sensing device frame is secured to said machine frame by a plurality of fasteners.

15. The imaging apparatus of claim 11, wherein one of said printhead housing and said position sensing device frame includes a first reference datum and the other of said printhead housing and said position sensing device frame includes a first datum locator for engaging said first reference datum.

16. The imaging apparatus of claim 15, wherein said first reference datum forms a V-shaped slot.

17. The imaging apparatus of claim 15, wherein said first reference datum forms a slot having a polygonal shape.

18. The imaging apparatus of claim 15, wherein said printhead housing is secured to said machine frame by a plurality of fasteners.

19. The imaging apparatus of claim 15, wherein said printhead housing includes a slotted aperture for adjusting a location of said first datum locator relative to a body of said laser printhead housing.

20. An imaging apparatus, comprising:

a machine frame;

a laser printhead housing for housing a laser printhead which generates a laser beam; and a position sensing device, said position sensing device including a position sensing device frame, a mirror and a position sensor, said position sensor receiving a reflection of said laser beam from said mirror for sensing an orientation of said laser beam, said position sensing device frame being interposed between said machine frame and said laser printhead housing for mounting said laser printhead housing to said machine frame, wherein each of said machine frame, said laser printhead housing and said position sensing device frame includes at least one reference feature that in combination accurately reference the position of said laser printhead housing to said machine frame.

21. The imaging apparatus of claim 20, wherein one of said machine frame and said position sensing device frame includes at least one reference hole and the other of said machine frame and said position sensing device frame includes at least one alignment pin, wherein each alignment pin engages a corresponding reference hole.

22. The imaging apparatus of claim 21, wherein said each reference hole forms a V-shaped slot.

23. The imaging apparatus of claim 21, wherein said each reference hole forms a slot having a polygonal shape.

24. The imaging apparatus of claim 21, wherein said position sensing device frame is secured to said machine frame by a plurality of fasteners.

25. The imaging apparatus of claim 21, wherein one of said laser printhead housing and said position sensing device frame includes a first reference datum and the other of said laser printhead housing and said position sensing device frame includes a first datum locator for engaging said first reference datum.

26. The imaging apparatus of claim 25, wherein said first reference datum forms a V-shaped slot.

27. The imaging apparatus of claim 25, wherein said first reference datum forms a slot having a polygonal shape.

28. The imaging apparatus of claim 25, wherein said laser printhead housing is secured to said machine frame by a plurality of fasteners.

29. The imaging apparatus of claim 25, wherein said laser printhead housing includes a slotted aperture for adjusting a location of said first datum locator relative to a body of said laser printhead housing.

* * * * *